US005586493A

United States Patent [19]

McEntee

[11] Patent Number: 5,586,493

[45] Date of Patent: Dec. 24, 1996

[54] PAPER RECYCLING RACK

[76] Inventor: Marjorie N. McEntee, 3350 Airport Rd. #42, Allentown, Pa. 18103

[21] Appl. No.: 580,977

[22] Filed: Jan. 3, 1996

[51] Int. Cl.[6] ..... B65B 27/08

[52] U.S. Cl. ..... 100/34; D6/455; D6/475; 211/50

[58] Field of Search ..... 100/1, 34; 211/50; D6/455, 475

[56] References Cited

U.S. PATENT DOCUMENTS

| | | | |
|---|---|---|---|
| D. 159,165 | 6/1950 | Rippe | 100/34 |
| D. 162,226 | 2/1951 | Rippe | 100/34 |
| D. 230,802 | 3/1974 | Morita | 100/34 |
| 2,639,037 | 5/1953 | Friend | 100/34 |
| 2,818,180 | 12/1957 | Keene | 100/34 |
| 2,850,197 | 9/1958 | Hart | 100/34 |
| 3,171,347 | 3/1965 | Elrod | 100/34 |
| 3,357,344 | 12/1967 | Pate | 100/34 |
| 3,491,681 | 1/1970 | Saro et al. | 100/34 |
| 3,591,012 | 7/1971 | Grady | 100/34 |
| 3,739,714 | 6/1973 | Howard | 100/34 |
| 4,154,159 | 5/1979 | Ortega | 100/34 |
| 4,993,563 | 2/1991 | Bolling | 100/34 |
| 5,009,153 | 4/1991 | Kaji | 100/34 |
| 5,150,646 | 9/1992 | Lonczak | 100/34 |
| 5,181,460 | 1/1993 | Gremelsbacker | 100/34 |
| 5,201,864 | 4/1993 | Brackett | 100/34 |
| 5,272,966 | 12/1993 | Dixon | 100/34 |
| 5,388,506 | 2/1995 | Vargas et al. | 100/34 |

*Primary Examiner*—Stephen F. Gerrity
*Attorney, Agent, or Firm*—Richard C. Litman

[57] ABSTRACT

A paper recycling rack includes an upper paper stack binding area and a lower bundled paper storage area. The upper area comprises a platform having two orthogonally disposed channels thereacross and corresponding discontinuous side walls, with a generally rectangular stack of papers placed therein being supported at the four corners of the stack and being exposed along the orthogonal channels. Thus, a user of the rack may easily reach through the upper portion of the lower storage area to pass binding twine, cord or the like beneath papers stacked in the upper area to secure them together, and store the bound papers in the lower storage area for later transfer to a recycling point. The rack is preferably monolithically formed of an injection molded translucent, smoke tinted plastic material, but may alternatively be formed using other materials and manufacturing techniques as desired. The rack is particularly useful for the binding and storage of newspapers and is also valuable in the office environment for the recycling of computer paper and the like. Non-skid pads may be provided on the bottom of the paper storage area to preclude slippage on the floor, or alternatively on a table, desk or other area.

14 Claims, 2 Drawing Sheets

PAPER RECYCLING RACK

FIELD OF THE INVENTION

The present invention relates generally to special purpose racks, stands, and the like, and more specifically to a rack providing for the bundling and storage of papers therein for later recycling. The rack includes an upper portion adapted for the placement of loose papers therein for tying or otherwise securing together, and a lower portion adapted for the storage of loose or bundled papers therein. The rack is particularly adapted for use in recycling newsprint, but may be used equally as well for the recycling of other paper products.

BACKGROUND OF THE INVENTION

With increasing population pressures and the ever increasing consumption of various goods and commodities by people, a corresponding increasing concern over the sheer volume of disposable materials has developed. It is increasingly recognized that the volume of trash which may be accepted by landfills is not infinite, and accordingly a greater emphasis on the recycling of various used products, packaging, and commodities has developed.

Nowhere is this more true than in the paper industry, where hundreds of tons of newsprint and other paper products are produced daily. In the past, much of this material was burned, but this process is not only wasteful, but also discouraged due to the atmospheric pollution produced. The alternative is to recycle the used paper, and while various devices have been developed in the past to assist in this cause, none have truly provided the convenience required in order to encourage persons to recycle.

Accordingly, a need will be seen for a paper recycling rack which provides an upper platform including slots therein adapted for the passage of baling twine or the like therethrough, and providing a convenient working height for a person to bundle a stack of papers. The tied and bundled papers may then be stored in the lower or base portion of the rack, for future transfer to a recycling facility when convenient. The rack must be adapted not only for the bundling and storage of newsprint, but must also be capable of providing for the bundling and storage of other forms of paper, e.g., office computer paper and the like, as well as other paper products.

DESCRIPTION OF THE PRIOR ART

U.S. Pat. No. 2,850,197 issued to Milburn F. Hart on Sep. 2, 1958 describes a Newspaper Holding And Bundling Receptacle formed of a plurality of wire components and using clips to secure the wires together. The frame includes orthogonal slots providing for the passage of bundling twine or the like therethrough, but the thin wire frame requires a continuous upper periphery for structural strength, thus requiring the user to maneuver the twine awkwardly beneath the upper peripheral member. Moreover, the Hart rack provides only a limited space beneath the stacked papers, precluding the storage of tied and bundled papers in the bottom portion of the rack, as evidenced by the relative height of the bundled paper stack in the upper portion of the rack and the twine passage portion therebelow, which lower portion has only a small fraction of the height of the overall rack.

U.S. Pat. No. 3,357,344 issued to Sherman E. Pate on Dec. 12, 1967 describes a Stacking And Bundling Device formed of a folded sheet of corrugated fiberboard. No channels or slots are provided around and beneath the paper platform or shelf to enable a user to pass twine or cord about a stack of papers placed therein. Rather, the user must place the cord within the box, then pick up the loosely stacked papers from another location and place them atop the twine or cord in the box, and finally tie the stacked papers together. The present rack greatly simplifies the process, by allowing papers to be placed singly and directly in the top portion of the rack as they are discarded, rather than requiring them to be placed elsewhere and then transferred for bundling. Moreover, the present rack also provides for the convenient storage of bundled papers within the rack, unlike the Pate box structure.

U.S. Pat. No. 3,491,681 issued to Joseph Z. Saro, Jr. et al. on Jan. 27, 1970 describes a Baling And Storage Container comprising a box having a closed bottom and four sides. The bottom and sides are provided with slots or channels therein for the placement of baling twine or cord therein. Thus, the cord or twine must first be placed in the channels of the container, and the loosely stacked papers transferred from another location to the container, before the papers can be tied or baled. As in the Pate box discussed immediately above, no provision is made for the storage of papers, either loose or bundled, beneath the portion of the device used for the tying or bundling of the papers. The result is less than ideally convenient, requiring (1) a first place to store loose papers, (2) a second place for the Saro, Jr. et al. container, and (3) a third place to store the bundled papers until they can be transferred for recycling.

U.S. Pat. No. 3,591,012 issued to Maurice J. Grady on Jul. 6, 1971 describes a Rack, Particularly For Holding And Tying Newspapers. The rack is formed of a series of wire segments clipped together, and is at least somewhat similar to the rack of the Hart patent discussed further above. Grady improves upon the Hart device by providing a discontinuous, open periphery, enabling a person to pass twine or cord about papers stacked within the Grady rack without having to maneuver about the upper peripheral frame. However, Grady still does not recognize the need for the storage of tied and bundled papers, and makes no provision for such storage within his rack, whereas the present invention provides for the stacking, tying, and storage of bundled papers all in a single device.

U.S. Pat. No. 3,739,714 issued to William E. Howard on Jun. 19, 1973 describes a Device For Holding And Bundling Newspapers, comprising a wire rack having outer dimensions smaller than the size of the sheets to be bundled. Only two opposite retaining frames are provided, with the papers stacked therebetween with an arcuate fold as they collapse between the opposite ends. Twine or cord is then used to secure the opposite ends of the bundle, which extend beyond the frame of the Howard device, together. Howard makes no provision for storing the bundles within his rack, as the arcuately curved bundles formed using the Howard rack cannot be stacked atop one another, as provided by the flat bundled stacks formed using the present rack. Moreover, Howard makes no provision for two orthogonal ties with his rack. Thus, papers bundled using the Howard rack, may slip from one end of the bundle, as there is no retaining cord or twine about the bundle in one dimension.

U.S. Pat. No. 4,993,563 issued to Ambrose Bolling on Feb. 19, 1991 describes a Stacking And Bundling Apparatus having an adjustable width to accommodate different sizes of scrap cardboard or other material. Channels are provided within the base for the passage of "banding material" (not twine or cord) therethrough. This is an important distinction, as the Bolling channels are relatively thin and narrow, and require a relatively stiff plastic or metal strap to be used therewith in order to pass beneath a stack of material within the device. The relatively flaccid and flexible string, twine, or cord used in bundling or baling papers stacked within the present rack, must be pulled through the rack and passed from hand to hand through the rack; such flexible material cannot be pushed through a narrow channel. Moreover, Bolling fails to recognize the need for convenience and does not provide for storage of bundled or baled materials with his apparatus, as provided by the present invention.

U.S. Pat. No. 5,009,153 issued to Joel T. Kaji on Apr. 23, 1991 describes a Device And Method For Bundling, comprising a tray with a removable seat member and plurality of draw strings. The seat member is placed within the tray and papers stacked thereon. When the stack is completed as desired, the draw strings are drawn about the papers (including the seat below the stack), and tied to secure the bundle together. Thus, the seat component and a sleeve about a portion of the draw strings, are expendable and are secured to each bundle of papers formed using the Kaji device. accordingly, great care must be used to ensure that the materials used for the seat and draw string sleeve, are compatible with the processing used to recycle the papers secured thereby. Kaji is silent on the storage of bundled papers.

U.S. Pat. No. 5,150,646 issued to John Lonczak on Sep. 29, 1992 describes a Stacking And Bundling Form For Newspapers To Be Recycled, comprising a box having four sides and an open top and bottom. Opposite sides are separable by means of a cooperating tongue and slot arrangement. No lateral or bottom passages are provided for the user to pass twine or cord about papers stacked within the box. Rather, the twine must first be placed within the Lonczak box, then the papers stacked within the box and atop the twine, and finally the papers are tied or baled by securing the twine about the stack of papers within the box. The bundle must then be removed to another location for storage or transfer to a recycling point; Lonczak makes no provision for storage of bundled papers within the box, as provided by the present rack. Thus, Lonczak is more closely related to the corrugated fiberboard device of Pate, discussed further above, than to the present rack.

U.S. Pat. No. 5,181,460 issued to John Gremelsbacker on Jan. 26, 1993 describes a Device For Bundling Sheet Material, comprising four spaced apart columns with corner shelves in each of the columns providing for the support of a stack of paper or other sheet material above a base. The separate columns allow twine or cord to be passed therebetween, and between the stacked paper and the underlying base, for ease in bundling the material. The only function of the base is to support the four columns, two of which are adjustably spaced from the other two, for different sizes of sheet material. The space within the underlying base is completely enclosed and is inaccessible for storage of any articles, including bundles of baled paper or other material, whereas the present invention provides for the storage of baled or tied paper bundles beneath the upper portion used for stacking and tying the paper.

U.S. Pat. No. 5,201,864 issued to Ted Brackett on Apr. 13, 1993 describes a Newsprint Trash Compactor generally comprising a box with an open top and a spring supported lower platform therein. Opposite sides include paper sheet retaining means (bristles, etc.) therein, with a slot for bundling tape being provided also. No open passages are provided to pass twine or cord completely around the papers within the container; rather, the bundling tape must be laid out within the box before any papers are placed therein. Moreover, as in the other devices discussed further above, Brackett fails to provide any storage area for previously bundled stacks of paper, as provided by the present invention.

U.S. Pat. No. 5,272,966 issued to Richard W. Dixon on Dec. 28, 1993 describes a Method For Bundling Newspapers comprising a V-shaped structure into which papers are placed for bundling. As the papers are resting directly upon the surfaces of the central V of the structure, no twine, cord, or other binding may be passed directly beneath the stack of papers therein. Accordingly, Dixon anticipates tying the opposite ends of the bundle which extend beyond the V structure, and includes a space for twine beneath one arm of the V. The potential problems of two separate parallel ties slipping from either end of the bundle, or of the bundle slipping from the ties, as no transverse end tie is provided, have been noted above in the discussion of the wire frame device of the Howard patent. Also, as in the other devices discussed above, Dixon fails to provide any storage space within his device for previously bundled papers. Thus, papers bundled using the Dixon stacking device must still be removed to another location and later transferred to a recycling point, rather than being held conveniently in the stacker, as with the present device.

U.S. Pat. No. 5,388,506 issued to Augustin Vargas et al. on Feb. 14, 1995 describes a Newspaper Recycling Holder having four spaced apart upwardly extending legs, each with a corner shelf and further upwardly extending retaining walls above each shelf. The four separate legs and corner shelves define two transverse channels or gaps therebetween, providing for the passage of twine or cord therethrough to secure about a stack of papers placed upon the corner shelves. The base includes receptacles therein providing for the storage of twine or cord, and for the withdrawal and cutting of such binding therefrom. While one embodiment of the Vargas et al. device is formed essentially as a single unitary component, another embodiment comprised multiple components in order to provide for adjustment for different sized papers. However, a major deficiency of the Vargas device is its lack of storage space for previously bundled papers. While space is provided for a user of the device to pass cord or twine beneath the stack of papers resting upon the corner shelves, the space is insufficient for the storage of previously bundled papers, as placement of such bundles therein would reduce the space to the point that the user could no longer pass his/her hands beneath any papers resting upon the corner shelves to pass string or twine therearound. Moreover, Any bundled papers placed within the base area would rest upon the exposed spools of twine, thus interfering with their operation. In contrast, the present invention provides a much more spacious lower base portion, with retaining walls about three sides thereof for the storage of previously bundled papers therein. The upper portion of the lower storage area is open on all sides, in order that a user may pass twine or cord therethrough for the bundling of papers.

U.S. Pat. No. D-159,165 issued to Henry F. Rippe on Jun. 27, 1950 describes a design for a Newspaper Rack Or Similar Article, comprising an open base frame apparently formed of sheet metal components, and six rod-like uprights in a hexagonal array. The transverse elements of the base frame would preclude any passage of binding between the frame members and any papers resting thereon, as papers would rest directly upon the frame members. No storage space for bundled papers is provided below the base frame.

U.S. Pat. No. D-162,226 issued to Henry F. Rippe on Feb. 27, 1951 describes a design for a Newspaper Rack Or Similar Article, which rack includes a hexagonal array of upright rod members, as in the '165 patent to the same patentee discussed immediately above. The base frame of the device of the '226 patent is apparently formed of heavy wire or rod, rather than of sheet metal, as in the '165 patent. The same deficiencies still apply to the device of the '226 patent, however, as the frame configuration precludes clearance beneath any papers resting thereon in order for binding to be passed therearound and still clear the frame, and no storage space for bundled papers is provided.

None of the above noted patents, taken either singly or in combination, are seen to disclose the specific arrangement of concepts disclosed by the present invention.

SUMMARY OF THE INVENTION

By the present invention, an improved paper recycling rack is disclosed.

Accordingly, one of the objects of the present invention is to provide an improved paper recycling rack which includes a transversely slotted upper platform, adapted to support a generally rectangular stack of paper at the corners thereof and to provide clearance for securing two orthogonally disposed ties about the paper stack, an a lower paper storage area beneath the upper platform.

Another of the objects of the present invention is to provide an improved paper recycling rack which is monolithically formed as a single unitary component.

Yet another of the objects of the present invention is to provide an improved paper recycling rack which is injection molded or otherwise formed of a transparent, translucent, or opaque plastic material, or other material as desired.

Still another of the objects of the present invention is to provide an improved paper recycling rack which may include support means therebeneath, comprising rubber, neoprene, or other components of high friction coefficient to preclude slippage.

A further object of the present invention is to provide an improved paper recycling rack which is adapted for the bundling and storage of newspapers, but which may also be used for the bundling and storage of other sheet paper materials in the office and other environments.

A final object of the present invention is to provide an improved paper recycling rack for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
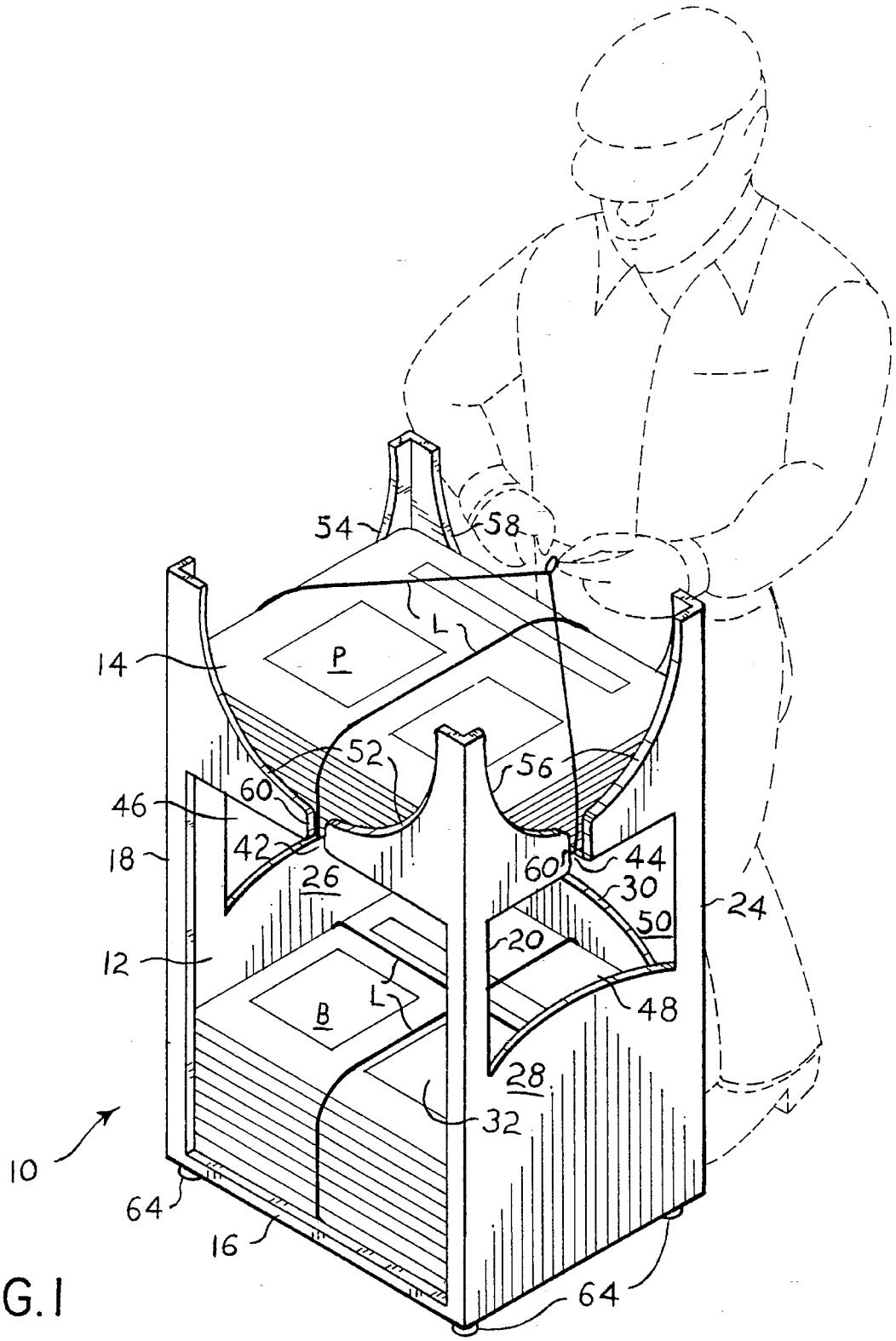
FIG. 1 is a perspective view of the present paper recycling rack, showing an upper stack of papers being bound together therein and a lower stack of bound papers stored therein.

Referring now to the drawings, the present invention will be seen to relate to a paper recycling rack 10 providing for the binding or baling of a stack of loose papers P and the storage of bound or baled papers B for future transfer to a recycling facility. The rack 10 generally comprises a lower paper storage area 12 and an upper paper binding area 14 thereabove, preferably sized to accommodate folded newspapers, which have a nominal size on the order of twelve by fourteen inches. (It should be noted that the rack 10 and papers P and B shown in FIG. 1 are enlarged considerably for clarity, relative to the user of the device shown in broken lines in the drawing.) The present rack 10 is also well adapted for use in the office environment, for the bundling and recycling of computer paper and other paper materials. "Legal" size computer sheets are only slightly narrower than newsprint, measuring fourteen inches long by slightly less than ten inches wide with the lateral printer sprocket feed strips along each edge.

Figure 3:
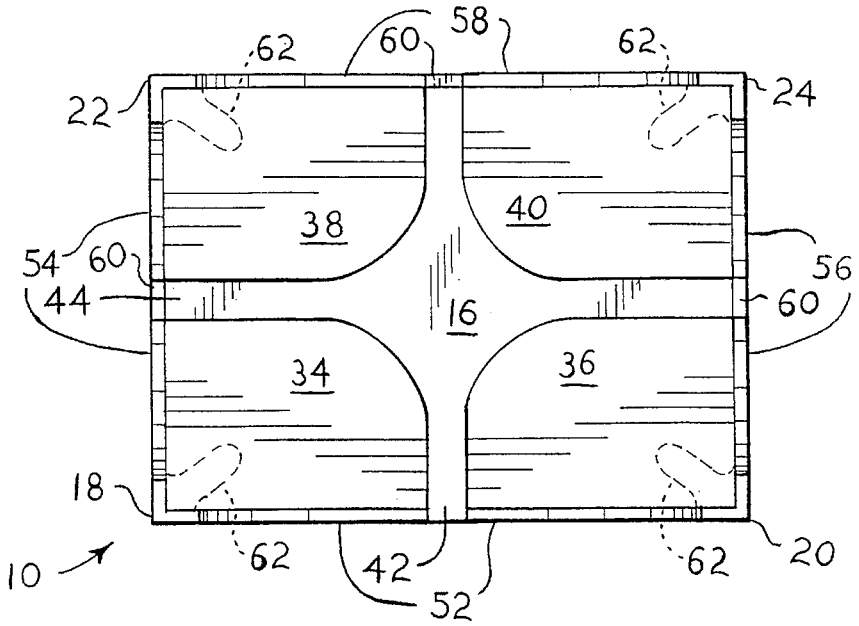
FIG. 3 is a top plan view of the present rack, showing further details.
Figure 2:
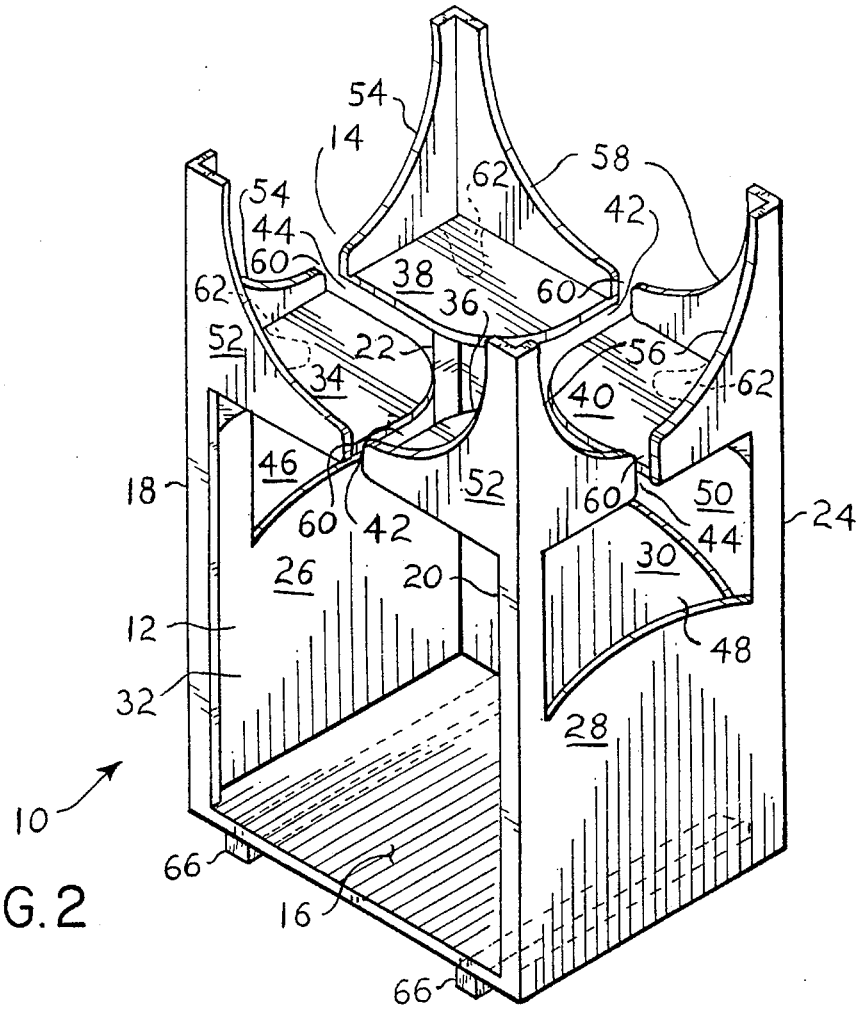
FIG. 2 is a perspective view similar to FIG. 1, but showing details of the present rack.

The lower paper storage area 12 includes a rectangular floor panel 16 having first through fourth upper platform supports 18, 20, 22, and 24 extending upwardly therefrom and forming the four corners of the rectangular rack 10; the third support 22 and corner defined thereby are shown in FIGS. 2 and 3 of the drawings. The lower storage area 12 includes opposite first and second side wall panels 26 and 28, respectively extending between the first and third supports 18 and 22 and the second and fourth supports 20 and 24, and a single rear wall panel 30 extending between the third and fourth supports 22 and 24. Each of these wall panels 26, 28, and 30 extends upwardly from the periphery of the lower floor panel 16, to leave a front paper storage access opening 32. It will be noted that the wall panels 26, 28, and 30 do not extend completely upward to meet the overlying paper binding area 14, but rather end short of that area, to provide lateral and rear access beneath the upper paper binding area 12.

Each of the upper platform supports 18 through 24 has a corresponding upper platform, respectively 34 through 40, extending inwardly therefrom generally toward its diagonally opposite member as shown in FIGS. 2 and 3. These platforms 34 through 40 form a generally rectangular array to support any papers P placed thereon generally beneath each quadrant of the rectangular paper stack. The upper paper support platforms-34 through 40 are each separate and at least slightly spaced apart from one another, with the spaces therebetween providing for a first and a second binding slot 42 and 44 therebetween. These binding slots 42 and 44 are orthogonally disposed to one another and allow the upper paper binding area space 14 to communicate with the lower paper storage area space 12.

As noted further above, the side and rear wall panels 26, 28, and 30 do not extend completely upward to the paper binding platforms 34 through 40, but have openings 46, 48, and 50 thereabove and below each of the platforms 34 through 40. These openings 46 through 50, along with the full front opening 32, communicate with the respective binding slots 42 and 44, thereby allowing a pair of orthogonally disposed binding lines L (i.e., twine, cord, etc.) to be passed through the side and rear openings 46 through 50, beneath the platforms 34 through 40, and around any papers P resting upon the platforms 34 through 40 to tie or bind them together, without interference from any structure of the rack 10.

Each of the upper paper support platforms 34 through 40 includes a peripheral paper retaining wall therealong, providing for the lateral retention of any loose papers P which may be stacked or placed upon the upper platforms 34 through 40. These walls comprise a front wall 52, opposite left and right side walls 54 and 56, and a rear wall 58, which respectively correspond to the front opening 32, first and second panels 26 and 28, and rear panel 30 of the rack 10. Each wall 52 through 58 is discontinuous due to a central gap 60 therein, which gaps 60 are continuations of the binding slots 42 and 44 and communicate therewith. The walls 52 through 58 are preferably cut lower adjacent the gaps 60 than at their upper platform support edges 18 through 24, as shown in FIGS. 1 and 2, in order to provide additional clearance for the hands of a user of the present recycling rack 10 while wrapping and tying or binding papers P within the upper paper binding area 14 of the rack 10. The walls 52 through 58 also provide additional structural strength for the corresponding platforms 34 through 40.

The platforms 34 through 40 are not supported from beneath by any peripheral walls, however, due to the need for openings 32, 46, 48, and 50 providing for the manipulation of binding lines L beneath papers P stacked in the upper portion 14 of the rack 10. Accordingly, additional strength for each of the platforms 34 through 40 is provided by a generally diagonal brace 62 beneath each platform 34 through 40, extending from the inside of the corresponding upper platform support 18 through 24, inwardly beneath each platform 34 through 40. Thus, the upper or paper binding portion 14 of the recycling rack 10 is provided with adequate structural strength by means of the upper paper retaining walls 52 through 58 and the underside brace 62 beneath each platform 34 through 40, in spite of the separation of the upper portion 14 of the rack 10 due to the paper binding slots 42 and 44.

The rack 10 is placed on a floor or the like to provide a convenient working height for the upper binding area 14. (The rack 10 may alternatively be placed on a counter or other raised surface if desired.) Such surfaces often have a relatively low coefficient of friction, and the interface between the plastic material of the present rack 10 and floor or other surface, may not provide the security desired for paper binding operations using the rack 10. Accordingly, a rack support means of relatively high coefficient of friction may be provided beneath the lower floor panel 16, if desired. The support means may comprise a plurality of spaced apart resilient pads 64 of rubber, neoprene, soft plastic, or other suitable material, as shown in FIG. 1, or may alternatively be formed of at least a pair of oppositely disposed resilient elongate strips 66 of suitable material, as shown in FIG. 2. Other frictional support means may be provided alternatively as desired.

As noted above, the present paper recycling rack 10 is particularly adapted for office or household use, and may be formed easily and inexpensively as a single, unitary component of monolithic construction, e.g., from injection molded plastic material, although other forms of construction may also be used. The use of a transparent or at least translucent plastic provides an attractive rack 10, with the translucent plastic being adapted for smoked tint shading in order to complement many other plastic articles used in the home and office (e.g., paper trays, etc.). The use of a translucent plastic material enables a user of the present rack 10 to be able to see more clearly, the binding process through the upper walls 52 through 58 and other structure of the present rack 10, as well as to see the quantity of bound papers B stored in the lower portion 12 of the rack 10, from any angle relative to the rack 10.

The present paper recycling rack 10 is used by stacking or placing any papers to be recycled (newsprint, computer paper, etc.) within the upper paper binding area 14, where it is supported by the separate platforms 34 through 40 and laterally retained by the upper walls 52 through 58. The papers P are then bound or baled by wrapping or passing a binding line L (twine, cord, string, etc.) about the paper P, using the openings 32, 46, 48, and 50 to pass the line L through the rack 10 and around the papers P, and through the two orthogonal binding slots 42 and 44, thus precluding any interference or inadvertent tying or securing of the papers P to the rack 10 in any way. The bound papers may then be lifted from the upper binding area 14, and placed within the lower bound paper storage area 12 for future transfer to a recycling point, as desired.

Accordingly, it will be seen that the present paper recycling rack 10 provides a most convenient means of addressing the need for paper recycling in the home, office, or other environment. Heretofore, the various devices adapted for paper recycling have provided for the binding of loose papers, but storage of the loose papers before binding and subsequent storage of those bound papers had to be provided at other locations. With the present rack 10, loose papers P may be placed directly into the upper binding area 14 with no need for preliminary preparation (i.e., placing twine or cord into the area, etc.) and may be bound at any desired point as described above, thus using the same location for both preliminary storage of loose papers and for the binding of those papers. The bound papers are likewise stored in the same rack 10, merely by lifting the bale from the upper area 14 and placing it in the lower area 12. Thus, the present rack 10 provides an extremely efficient, compact, and convenient means of addressing these various tasks associated with paper recycling, all in a single unit.

It is to be understood that the present invention is not limited to the sole embodiment described above, but encompasses any and all embodiments within the scope of the following claims.

I claim:

1. A paper recycling rack providing for the bundling of loose papers and storage of bundled papers therein, said rack comprising:

a lower paper storage area comprising a generally rectangular floor panel having first through fourth upper platform supports extending upwardly therefrom and defining four corners for said floor panel and said rack;

a pair of elongate strips of resilient material oppositely disposed beneath said floor panel;

separate first through fourth upper platforms each extending inwardly from a respective one of said upper platform supports, with said upper platforms disposed in a rectangular array and defining first and second orthogonally disposed binding slots therebetween;

said upper platforms each having an opening therebelow, with each said opening communicating with a respective one of said binding slots and providing for the passage of binding material therethrough, and;

first through fourth discontinuous peripheral upper paper retaining walls each extending upwardly from said upper platforms, with each of said walls including a gap therein corresponding to and communicating with a respective one of said binding slots and providing for the passage of binding material therethrough and about any papers resting upon said upper platforms, whereby;

papers are placed in a generally rectangular stack upon said upper platforms and binding material is secured orthogonally about the stack by means of access provided by said openings below said upper platforms, said binding slots, and each said gap in said upper paper retaining walls, with bound stacks being placed within said lower paper storage area for transfer to a recycling facility.

2. The paper recycling rack of claim 1, including:

opposite first and second side wall panels and a rear wall panel extending upwardly from said floor panel, and an open front paper storage access opposite said rear wall panel.

3. The paper recycling rack of claim 1, wherein:

each of said upper platforms includes a generally diagonally disposed brace therebelow, extending from a respective one of said upper platform supports and beneath a corresponding one of said upper platforms to provide additional strength therefor.

4. The paper recycling rack of claim 1, wherein:

said upper paper retaining walls are relatively higher adjacent said upper platform supports than adjacent said gaps adjacent said binding slots, thereby providing increased clearance for paper binding operations.

5. The paper recycling rack of claim 1, wherein:

said rack is monolithically formed as a single unitary component.

6. The paper recycling rack of claim 1, wherein:

said rack is formed of plastic material.

7. The paper recycling rack of claim 6, wherein:

said plastic material is translucent to provide for observation of paper contained therein.

8. The paper recycling rack of claim 7, wherein:

said translucent plastic material includes a smoke tint therethrough.

9. A paper recycling rack providing for the bundling of loose papers and storage of bundled papers therein, said rack being monolithically formed of plastic material as a single, unitary component and comprising:

a lower paper storage area comprising a generally rectangular floor panel having first through fourth upper platform supports extending upwardly therefrom and defining four corners for said floor panel and said rack;

a pair of elongate strips of resilient material oppositely disposed beneath said floor panel;

separate first through fourth upper platforms each extending inwardly from a respective one of said upper platform supports, with said upper platforms disposed in a rectangular array and defining first and second orthogonally disposed binding slots therebetween;

said upper platforms each having an opening therebelow, with each said opening communicating with a respective one of said binding slots and providing for the passage of binding material therethrough, and;

first through fourth discontinuous peripheral upper paper retaining walls each extending upwardly from said upper platforms, with each of said walls including a gap therein corresponding to and communicating with a respective one of said binding slots and providing for the passage of binding material therethrough and about any papers resting upon said upper platforms, whereby;

papers are placed in a generally rectangular stack upon said upper platforms and binding material is secured orthogonally about the stack by means of access provided by said openings below said upper platforms, said binding slots, and each said gap in said upper paper retaining walls, with bound stacks being placed within said lower paper storage area for transfer to a recycling facility.

10. The paper recycling rack of claim 9, including:

opposite first and second side wall panels and a rear wall panel extending upwardly from said floor panel, and an open front paper storage access opposite said rear wall panel.

11. The paper recycling rack of claim 9, wherein:

each of said upper platforms includes a generally diagonally disposed brace therebelow, extending from a respective one of said upper platform supports and beneath a corresponding one of said upper platforms to provide additional strength therefor.

12. The paper recycling rack of claim 9, wherein:

said upper paper retaining walls are relatively higher adjacent said upper platform supports than adjacent said gaps adjacent said binding slots, thereby providing increased clearance for paper binding operations.

13. The paper recycling rack of claim 9, wherein:

said plastic material is translucent to provide for observation of paper contained therein.

14. The paper recycling rack of claim 13, wherein:

said translucent plastic material includes a smoke tint therethrough.

* * * * *